US006409794B2

(12) United States Patent
Wolmer et al.

(10) Patent No.: US 6,409,794 B2
(45) Date of Patent: Jun. 25, 2002

(54) METHOD FOR PRODUCING COMPOSITE POWDERS BASED ON SILVER-TIN OXIDE, THE COMPOSITE POWDERS SO PRODUCED, AND THE USE OF SUCH POWDERS TO PRODUCE ELECTRICAL CONTACT MATERIALS BY POWDER METALLURGY TECHNIQUES

(75) Inventors: Roger Wolmer, Gelnhausen; Mechthild Mueller, Hasselroth; Frank Heringhaus, Alzenau; Dietrich Ruehlicke, Freiberg/Sachsen, all of (DE); Dan Goia, Branchburg, NJ (US)

(73) Assignee: DMC$^2$ Degussa Metals Catalysts Cerdec AG, Frankdurt am Main (DE)

( * ) Notice: Subject to any disclaimer, the term of this patent is extended or adjusted under 35 U.S.C. 154(b) by 0 days.

(21) Appl. No.: 09/825,363

(22) Filed: Apr. 4, 2001

(30) Foreign Application Priority Data

Apr. 6, 2000 (DE) ..... 100 17 282

(51) Int. Cl.$^7$ ..... B22F 3/12; B22F 3/24; B22F 9/18

(52) U.S. Cl. ..... 75/232; 75/255; 419/28; 419/29; 419/30; 419/34; 419/38

(58) Field of Search ..... 75/232, 255; 419/30, 419/34, 38, 28, 29

(56) References Cited

U.S. PATENT DOCUMENTS 5,798,468 A * 8/1998 Weise et al. ..... 75/232
5,846,288 A * 12/1998 Jost et al. ..... 75/252

FOREIGN PATENT DOCUMENTS

EP 370891 5/1992

* cited by examiner

*Primary Examiner*—Daniel J. Jenkins
(74) *Attorney, Agent, or Firm*—Kalow & Springut LLP

(57) ABSTRACT

A method for producing composite powders based on silver-tin oxide, by chemically reductive precipitation of silver onto particulate tin oxide. A solution of a silver compound and a solution of a reducing agent are simultaneously added in stoichiometrically equivalent amounts, separately and continuously with intensive mixing, to an aqueous suspension of tin oxide. The resulting composite powders have very high homogeneity, and can be processed to make electrical contact materials. The method is particularly suitable for producing composite powders based on silver-tin oxide doped with indium oxide, to be used in the manufacture of electrical contact materials.

16 Claims, 1 Drawing Sheet

METHOD FOR PRODUCING COMPOSITE POWDERS BASED ON SILVER-TIN OXIDE, THE COMPOSITE POWDERS SO PRODUCED, AND THE USE OF SUCH POWDERS TO PRODUCE ELECTRICAL CONTACT MATERIALS BY POWDER METALLURGY TECHNIQUES

BACKGROUND OF THE INVENTION

1. Field of the Invention

The present invention relates to composite powders based on silver-tin oxide, and to methods for making them. The invention relates also to electrical contact materials made from such composite powders.

2. Description of the Related Art

Electrical contact materials typically consist of silver with certain metal and/or oxide additives. These materials are made using powder metallurgy techniques.

The materials are chosen based on the intended use, such as the type of switching device, the switching current, and the electrical load. General requirements include low electrical wear with high arc resistance, and low weld force with low contact resistance.

The air contactors of low voltage/high current equipment, within a switching current range of 100–3000 A, are primarily made with materials based on silver-tin oxide, in which the oxide content, in practice, lies between about 8 and 12 wt. %. Contact materials of this type generally have acceptable arc resistance; sufficient safety with respect to contact welding; comparable low material migration with low contact resistance and good overtemperature behavior; and practical processing and jointing properties.

Further improvements in the processing and contact properties of these Ag—$SnO_2$ materials are desired, as is an increase in their range of applications. Further developments in materials and technology are therefore to be expected. Such developments might well involve variations in the primary oxides, the other oxide additives, and the manufacturing technology, particularly technology aimed at controlling the structure-dependent properties.

The oxide components used are typically selected with the goal of improving the contact properties, thus reducing the specific contact erosion. Other goals include improving the contact resistance, the overtemperature and the weld force and weld frequency. These are prerequisites for obtaining a high load carrying capacity, a greater lifetime, and improved reliability of the contact system. Typical oxide additives used for contact materials based on Ag—$SnO_2$ include tungsten oxide, molybdenum oxide, bismuth oxide, copper oxide and indium oxide, used individually or in combination on the basis of their specific effects. These oxides are chosen mainly based on their thermodynamic properties, as well as on their wetting behavior in the $Ag_{liquid}/SnO_2$ system (Jeannot, et al., IEEE Proceedings Holm Conference 1993, p. 51).

Silver oxide powders used as precursors for contact materials are typically made using one of the following processes: powder metallurgy mixing techniques; internal oxidation of alloying powders or compact bodies under elevated oxygen partial pressure; and the chemically reductive precipitation of some or all of the components of the material. Further processing of the composite powders to semi-finished contacts or contact units, as a rule, takes place by cold isostatic compaction of the powders, followed by sintering and extrusion, and reforming to the end size.

The powder metallurgy mixing techniques for producing composite powders consist of mechanical homogenization of solid starting substances in powder form in a mixer, for the most part using only the silver and the oxide additive, but frequently also adding other additives or sintering aids. The method can be used either wet or dry, for instance with water, alcohol, etc., but is limited to powders having a particle size greater than 1 $\mu$m. The conventional mixing technique runs up against the technical limits in manufacturing composite powders having extremely finely divided oxide distributions, because of the particle and granule sizes, as well as because of the more or less pronounced agglomerate formation.

Because of the need for a homogeneous, very finely dispersed microstructure of the oxide phases, either the internal oxidation method or the chemically reductive precipitation method is used. The preferred contact materials are silver-tin oxide doped with indium oxide, having a homogeneity as high as possible. Manufacture of these preferred contact materials has up to now taken place only using the internal oxidation process, which is costly.

In the internal oxidation process, the formation of the oxide additive takes place either on an alloying powder atomized from the melt, or on the product produced by powder metallurgy or melt metallurgy. However, this technique can only be used with the typically used oxides if special measures are taken. If the external oxidation phenomena are successfully suppressed, which otherwise lead to passivation of the process, oxide particles with particle sizes around 100 nm can be produced.

In the process of chemically reductive precipitation, in contrast, the components of the material are precipitated from an ionic solution. This can involve either the complete precipitation of all of the material components, including the oxides; or precipitation of silver onto components suspended in an aqueous solution. In the first variation, the distribution of the components is dependent on the reaction kinetics. In the second variation, the particle size of the suspended components is the determining factor for the microstructural fineness of the end product.

These different processes produce different structural formations in the metal and oxide phases of the silver matrix; produce significant changes in the structure-dependent material properties; and thus produce significant changes in the processing and contact properties, which are difficult to predict in terms of size and tendency.

Chemically reductive processes of composite powder manufacture which have been recently developed are based chiefly on the principle of precipitation of silver onto oxides suspended in an aqueous solution. However, these processes differ with regard to the oxides used and their particle sizes, the precipitation systems, and the course of the reaction. Thus, considerable differences with respect to the quality of the composite powders necessarily result from different system- and process-related structural formations of the oxide phases of the silver matrix.

EP 0 370 891 describes the manufacture of contact materials from silver-tin oxide particles which optionally contain additional small amounts of copper oxide as dopant. These particles are obtained by adding a strong base to a silver nitrate solution, containing tin oxide having a specific particle size, in order to precipitate the silver oxide onto the tin oxide particles. In a further step, the resulting powder is heated in order to reduce the silver oxide to metallic silver. However, this method is limited with respect to the choice of doping agents, since many of the doping materials of interest for contact materials dissolve in a highly basic environment and thus do not reappear in the precipitation product.

U.S. Pat. No. 5,846,288 describes the manufacture of composite powders by precipitation of silver onto certain oxide base materials that are optionally doped with selected elements. Compaction, breaking, and grinding operations which follow the precipitation are necessary in order to obtain from the precipitation product a homogeneous and free-flowing powder from which compact contact materials can then be made. The precipitation process takes place either so that a suspension of the oxide in a silver nitrate solution is sprayed into a reactor containing a reduction agent (hydrazine hydrate is disclosed) or, vice versa, hydrazine hydrate is sprayed into a reaction vessel containing a suspension of the oxide in a silver nitrate solution.

Hydrazine is known to be dangerous to human health and the environment. The disclosed method has the additional disadvantage that it produces a considerable fraction of finely divided silver particles that are isolated and thus are not bonded to oxide particles. This has a fundamental adverse affect on the homogeneity of the composite powder. Also, in the further processing to a compact material, it turns out that coarser silver clusters form to a considerable extent.

The present invention has the goal of influencing the processing and contact properties of contact materials based on Ag—$SnO_2$, having an essentially conventional composition, by the appropriate design of the manufacturing process, and in particular, with the goal of maximum homogeneity and particle fineness. Above all, the intention was to be able to use a wide choice of dopants, and in particular, to use indium oxide.

SUMMARY OF THE INVENTION

The present invention obtains surprising improvements in the processing and contact properties of contact materials based on silver-tin oxide made using the powder metallurgical process. Specifically, the invention relates to a silver-tin oxide composite powder obtained by chemically reductive precipitation of silver onto particulate tin oxide. The precipitation is carried out so that a solution of a silver compound and a solution of a reducing agent are added to an aqueous suspension of tin oxide simultaneously, in stoichiometrically equivalent amounts, separately and continuously over the course of the reaction, with intensive mixing.

The invention thus relates also to methods for producing such composite powders based on silver-tin oxide, by chemically reductive precipitation of silver onto particulate tin oxide. The method is characterized in that a solution of a silver compound and a solution of a reducing agent are added to an aqueous suspension of tin oxide simultaneously, in stoichiometrically equivalent amounts, separately and continuously over the course of the reaction, to reductively precipitate the silver onto the particulate tin oxide. Such reducing agents are therefore also known as precipitation agents.

The invention also relates to the use of composite powders made in this way for the powder metallurgical manufacture of contact materials based on silver-tin oxide.

BRIEF DESCRIPTION OF THE DRAWING

The invention will be better understood with reference to the accompanying drawing, in which.

DETAILED DESCRIPTION OF THE INVENTION

Figure 1:
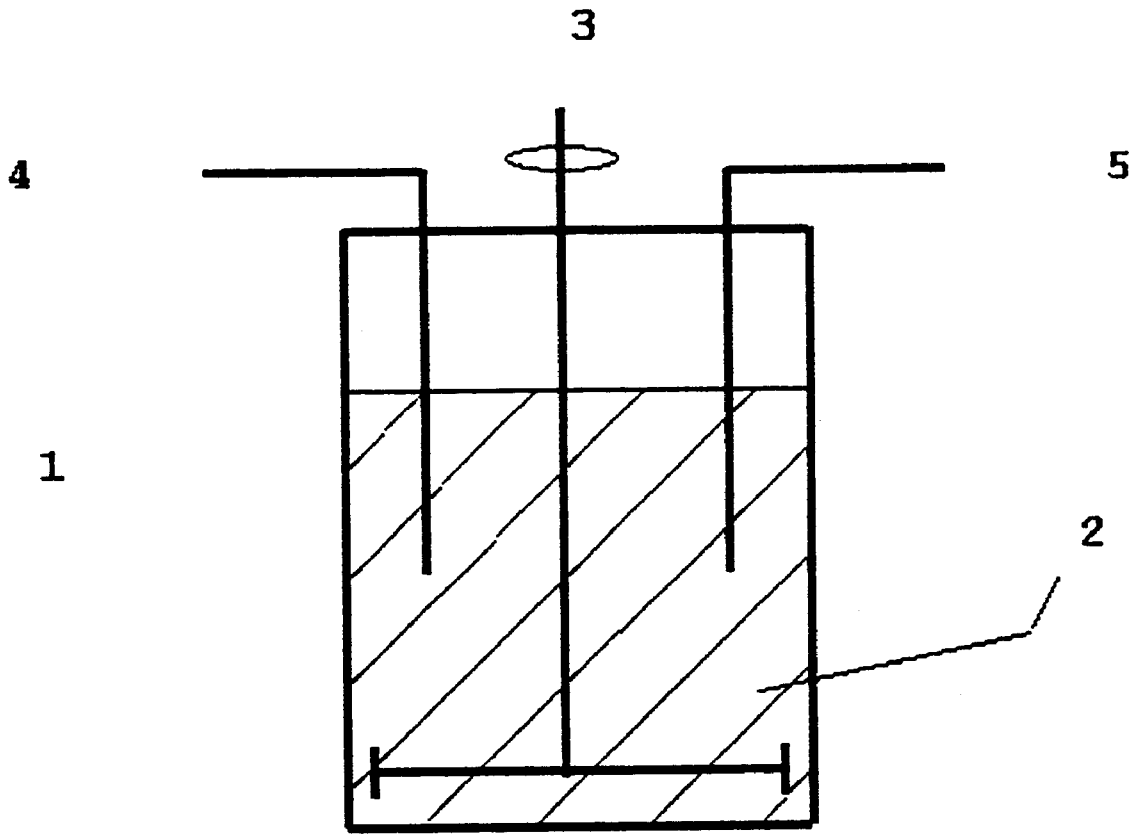
FIG. 1 shows a schematic drawing of the equipment used for conducting the precipitation reaction in accordance with the invention.

An aqueous oxide suspension (2) is provided in a reaction vessel (1). The suspension is intensively mixed by stirrer (3). By means of two separate connections (4, 5), whose nozzles are below the liquid level of the oxide suspension (2), a solution of the silver compound (4') and the reducing agent (5') are simultaneously fed to the oxide suspension, so that metallic silver is precipitated onto the suspended oxide particles.

The process for producing composite-powder-based silver-tin oxide according to the invention, by chemically reductive precipitation of the silver onto suspended particulate tin oxide, can be carried out using a variety of reaction systems, oxides and particle sizes. Provided that the feed of the two reactants takes place simultaneously but spatially separate from one another (two-nozzle precipitation, duel jet precipitation), the process is not critical with respect to the chemical nature of the precipitation system, the oxides that are used (second phases), and their particle sizes. Because the second phases are present in an aqueous suspension, practically all of the oxides typically used as second phases for contact materials, which are by nature insoluble in water, can easily be used.

A wide variety of silver compounds can be used, in particular silver salts that are soluble in an aqueous medium. Typical silver salts of this kind include, for example, silver nitrate, silver acetate, silver carbonate, silver citrate, and silver oxalate. Silver nitrate is especially preferred. The silver compounds are dissolved in water or a suitable water-miscible solvent, the pH being adjusted if necessary in order to avoid any precipitation of the silver compound.

The process of the invention for carrying out the precipitation of silver onto the suspended oxide, with the simultaneous but separate feed of a solution of a silver compound and a solution of a reducing agent, with intensive mixing, guarantees that the oxide particles will be immediately surrounded by silver and thus protected from possibly aggressive, oxide-dissolving components of the reductive precipitation agent. Thus a broad range of reducing agents can be used as precipitation agents, without regard to their acidic or basic properties. Typical precipitation agents are reducing agents selected from the group consisting of ascorbic acid, citric acid, oxalic acid, formic acid, hydroxylamine, and mixtures thereof Ascorbic acid is especially preferred. The reducing agents are dissolved expediently in water or a suitable water-miscible solvent. The feed of the silver salt solution and the reducing agent solution to the oxide particle suspension takes place in stoichiometrically equivalent amounts, continuously over the entire course of the reaction, in order to guarantee uniform precipitation of the silver onto the oxide particles.

The typical second phase is tin oxide ($SnO_2$). The second phase can be provided with other additives, for instance $In_2O_3$, $WO_3$, $Bi_2O_3$, $MoO_3$ and CuO. $In_2O_3$ is especially preferred. The preferred ratio of $SnO_2$ to other oxides such as, in particular, $In_2O_3$, is 3:1 or higher, in each case according to the requirements on the contact material to be made from the powder with respect to the switching load.

In the process according to the invention, the fractions of silver salt, tin oxide and optional oxide additives are preferably selected so that, in the composite powder, there are 2 to 16 wt % tin oxide and 0.05 to 10 wt % additional oxides, with the remainder being silver. The ratio of amounts is especially preferably set so that the composite powder contains 2 to 16 wt % tin oxide, 0.5 to 8 wt % indium oxide and 0 to 2 wt % other oxides, with the remainder being silver.

The process in accordance with the invention allows the use of very fine second phases. With a view to maximizing the oxide homogeneities and finenesses, second phases with particle sizes less than 1 $\mu$m are especially preferred.

The amounts of the starting substances, their relevant concentrations in the relevant aqueous solution or suspension, and the feed rates of the silver salt solution and reducing agent solution to the oxide particle suspension are likewise not critical, so long as there is a sufficiently intensive mixing, for instance with the aid of a conventional high-energy stirrer system. A feed rate of from 0.002 to 0.2 mol/sec for the silver salt solution, and from 0.001 to 0.1 mol/sec for the reducing agent solution, have proved to be particularly preferred in conducting the inventive process. It is particularly advantageous when the spatial separation of the silver salt solution from the reducing agent solution takes place below the liquid surface of the oxide suspension.

The process in accordance with the invention is especially suitable for the production of a particularly homogeneous silver-tin oxide composite powder doped with indium oxide which, until now, could be produced in comparable quality only by using the method of internal oxidation.

The composite powders produced by the process according to the invention, and the materials prepared from them, are characterized by an extremely homogeneous and very finely dispersed oxide distribution. The average linear values of the oxide particle size lie in the range of about 100–150 nm, and the oxide particle spacings lie in the range of about 600–800 nm. The oxide particles thus correspond to the structural parameters of internal oxidized materials, being the technical standards, having such finely dispersed and homogeneous oxide distributions had heretofore been achieved only in combination with additional process measures.

The chemical properties of the composite powders produced according to the invention are equivalent to or better than the values of internal oxidized materials in the extruded state, and in the delivered state, as a microprofile shape.

Advantages of the contact materials according to the invention include a simpler, more flexible, and more cost favorable manufacturing process compared to that of the internal oxidized materials, while obtaining the excellent material and contact properties of the internal oxidized materials. Further, the homogeneous, very finely dispersed oxide distributions achieved according to the invention generally cannot be obtained using the conventional powder metallurgical mixing techniques. The structure-dependent properties resulting from the deficiencies in the prior art processes cited are a further disadvantage in many applications.

EXAMPLE

To produce a 4-kg batch of a composite powder for the contact material Ag—$SnO_2$—$In_2O_3$, having about 9 wt % $SnO_2$ and about 3 wt % $In_2O_3$, with extremely high oxide dispersion in the silver matrix, equivalent amounts of the starting powders of the oxides, with an average particle size of $D_{50}$=0.7 $\mu$m, are suspended in 3 L of deionized water, by means of a disperser, over a period of 30 min., at room temperature, and then stirred into 18 L of deionized water in a 50-L reaction vessel. By the simultaneous and uniform feed of stoichiometric amounts of 3.5 mol silver nitrate and 1.7 mol ascorbic acid solutions through two separate connections (see FIG. 1), with simultaneous thorough mixing using a high energy stirrer system, metallic silver is precipitated onto the oxide particles at a constant rate of about 130 g/min. The temperature in the reaction vessel is limited to 40° C. through cooling. The precipitation products produced in this way are separated from the remaining liquid by vacuum filtration, washed, dried and screened to 500 $\mu$m.

The further processing of the material to intermediate contacts, or contact pieces, takes place by cold isostatic compaction at 800 bar, sintering at 880° C. for 2 h, extrusion, heated-roller hardening, and shaping to the end size.

The metallographic investigation of the contact material shows in the micrograph a uniform, homogeneous, agglomerate-free structure with maximum oxide phase particle sizes of 130 nm with a coefficient of variation of a maximum of 10%.

Table 1 shows selected material data for silver-tin oxide composite powders of the composition according to the above example that were doped with indium oxide and produced in accordance with the invention, and of contact materials made from them, in a comparison with a material of the corresponding overall composition produced in accordance with the prior art through internal oxidation.

TABLE 1

| Properties (microprofile 0.6 mm thick)[1] | Prior art[2] | Inventive Example |
|---|---|---|
| Microstructure | | |
| Oxide particle size (nm) | 129 | 133 |
| Oxide particle spacing (nm) | 644 | 700 |
| Coefficient of variation (%) | 5–10 | 5–10 |
| Mechanical characteristics | | |
| Vickers hardness HV5 | 107 | 123 |
| Breaking elongation A (%) | 10 | 9 |
| Breaking strength $R_m$ (N.mm$^2$) | 352 | 375 |
| $R_m \times A \times 10^{-2}$ (N.mm/mm$^3$) | 35,2 | 33,7 |

[1]Roll-hardened state
[2]Internal oxidized comparison material of corresponding composition Further variations and modifications will be apparent to those skilled in the art from the foregoing and are intended to be encompassed by the claims which follow.

German priority application 100 17 282.2 is relied on and incorporated herein by reference.

We claim:

1. A method for producing a composite powder, comprising simultaneously adding to an aqueous suspension of particulate tin oxide, separately and continuously with intensive mixing, stoichiometrically equivalent amounts of: i) a solution of a silver compound, and ii) a solution of a reducing agent.

2. The process according to claim 1, wherein the silver compound comprises at least one silver salt.

3. The process according to claim 2, wherein the silver salt comprises at least one member selected from the group consisting of silver nitrate, silver acetate, silver carbonate, silver citrate, and silver oxalate.

4. The process according to claim 1, wherein the reducing agent comprises at least one member selected from the group consisting of ascorbic acid, citric acid, oxalic acid, formic acid and hydroxylamine.

5. The process according to claim 1, wherein the aqueous suspension of particulate tin oxide further comprises at least one metal oxide additive selected from the group consisting of $In_2O_3$, $Bi_2O_3$, CuO, $WO_3$ and $MoO_3$.

6. The process according to claim 3, wherein the aqueous suspension of particulate tin oxide further comprises at least one metal oxide additive selected from the group consisting of $In_2O_3$, $Bi_2O_3$, CuO, $WO_3$ and $MoO_3$.

7. The process according to claim 3, wherein the aqueous suspension of particulate tin oxide further comprises $In_2O_3$ provided as a metal oxide additive.

8. The process according to claim 6, wherein the amounts of silver salt, particulate tin oxide, and metal oxide additive provided are selected so that the resulting composite powder comprises from 2–16 wt % tin oxide, and from 0.05–10 wt % additional metal oxides derived from the at least one metal oxide additive, with a remainder of the composite powder comprised of silver.

9. The process according to claim 6, wherein the amounts of silver salt, particulate tin oxide, and metal oxide additive provided are such that the resulting composite powder comprises from 2–16 wt % tin oxide, from 0.5–8 wt % indium oxide derived from $In_2O_3$ provided as a metal oxide additive, and from 0–2 wt % additional oxides, derived from the at least one metal oxide additive, with a remainder of the composite powder comprised of silver.

10. The process according to claim 1, wherein the particulate tin oxide is comprised of particles smaller than 1 $\mu$m.

11. The process according to claim 5, wherein the at least one metal oxide additive is comprised of particles smaller than 1 $\mu$m.

12. The process according to claim 1, wherein the silver compound comprises at least one silver salt, wherein a feed rate for adding the silver salt solution is from 0.002 to 0.2 mol/sec, and wherein a feed rate for adding the reducing agent solution is from 0.001–0.1 mol/sec.

13. The process according to claim 1, wherein the simultaneous addition of the solution of a silver compound and the solution of a reducing agent takes place under the liquid surface of the aqueous suspension of particulate tin oxide.

14. A composite powder made by the process according to claim 1.

15. A contact material comprising a composite powder made by the process according to claim 1.

16. A method of making a contact material, comprising:

subjecting the composite powder according to claim 14 to a cold isotactic compaction at 800 bar;

sintering the compacted product at 880° C.;

extruding the sintered product;

hardening the extruded product using a heated roller; and shaping the hardened product.

* * * * *